US011622180B2

(12) United States Patent
Calisi et al.

(10) Patent No.: US 11,622,180 B2
(45) Date of Patent: Apr. 4, 2023

(54) COMMERCIAL LIGHTING INTEGRATED WITH LOUDSPEAKERS FOR SOUND MASKING, PAGING OR MUSIC

(71) Applicant: Biamp Systems, LLC, Beaverton, OR (US)

(72) Inventors: Christopher Calisi, Middleton, MA (US); Faruk Bursal, Lexington, MA (US); Robert Fleming, Lynnfield, MA (US); Gregory Saunders, Worcester, MA (US); Gordon V. Cook, Acton, MA (US)

(73) Assignee: Cambridge Sound Management, Inc., Waltham, MA (US)

( * ) Notice: Subject to any disclaimer, the term of this patent is extended or adjusted under 35 U.S.C. 154(b) by 0 days.

(21) Appl. No.: 16/457,109

(22) Filed: Jun. 28, 2019

(65) Prior Publication Data

US 2020/0007968 A1 Jan. 2, 2020

Related U.S. Application Data

(60) Provisional application No. 62/692,516, filed on Jun. 29, 2018.

(51) Int. Cl.

| | |
|---|---|
| ***F21V 33/00*** | (2006.01) |
| ***H04R 1/02*** | (2006.01) |
| ***H04R 9/06*** | (2006.01) |
| ***H04R 7/12*** | (2006.01) |
| ***H04R 1/34*** | (2006.01) |
| ***G10K 11/28*** | (2006.01) |
| ***G10K 11/175*** | (2006.01) |
| *F21Y 115/10* | (2016.01) |

(52) U.S. Cl.

CPC ..... *H04R 1/028* (2013.01); *F21V 33/0056* (2013.01); *G10K 11/1752* (2020.05); *G10K 11/28* (2013.01); *H04R 1/026* (2013.01); *H04R 1/345* (2013.01); *H04R 7/127* (2013.01); *H04R 9/06* (2013.01); *F21Y 2115/10* (2016.08); *H04R 2201/021* (2013.01)

(58) Field of Classification Search

CPC ..... G10K 11/175; G10K 11/1752; F21V 33/0056; H04R 2201/021

See application file for complete search history.

(56) References Cited

U.S. PATENT DOCUMENTS

| | | | | |
|---|---|---|---|---|
| 9,596,539 | B1 * | 3/2017 | Calisi | H04R 1/028 |
| 2011/0255711 | A1 * | 10/2011 | Ivey | F21V 33/0056 381/388 |
| 2011/0317861 | A1 * | 12/2011 | Haase | F21S 8/026 381/333 |
| 2012/0177232 | A1 * | 7/2012 | Katz | F21V 21/04 381/152 |
| 2014/0049939 | A1 * | 2/2014 | Kuenzler | F21S 8/04 362/84 |

* cited by examiner

*Primary Examiner* — Ping Lee

(57) ABSTRACT

A commercial lighting system, the system comprising, an integral housing adapted to be coupled to a ceiling of a building, a lighting unit mounted to the integral housing and a loudspeaker assembly mounted to the integral housing, the loudspeaker assembly comprising a low directivity index, and oriented to provide an acoustic sound signal from the integral housing to a listener in an area of the building comprising the ceiling.

10 Claims, 11 Drawing Sheets

COMMERCIAL LIGHTING INTEGRATED WITH LOUDSPEAKERS FOR SOUND MASKING, PAGING OR MUSIC

BACKGROUND

With the development of lighting based on Light Emitting Diodes (LED's), there is increasing development of creative and energy-efficient solutions for lighting in commercial spaces. At the same time, the acoustic environment of commercial spaces is used for purposes such as paging, music and sound masking. Freedom from distraction is an important consideration for workers' satisfaction with their office environment, and sound masking systems have been used to reduce the intelligibility of unwanted speech overheard in various office configurations.

However, there is an increasing desire to reduce the number of fixtures extending through ceilings, and there is an ongoing need to improve the ease of installation, aesthetic appearance, power requirements, cost, effectiveness and other characteristics of lighting systems and sound systems in commercial spaces.

SUMMARY

In one example commercial lighting system, the system comprising at least one of, an integral housing adapted to be coupled to a ceiling of a building, a lighting unit mounted to the integral housing and a loudspeaker assembly mounted to the integral housing, the loudspeaker assembly comprising a low directivity index, and oriented to provide an acoustic sound signal from the integral housing to a listener in an area of the building comprising the ceiling.

In another example commercial lighting system, the system comprising at least one of, an integral housing adapted to be coupled to a ceiling of a building, a lighting unit mounted to the integral housing and a loudspeaker assembly mounted to the integral housing, the loudspeaker assembly comprising a low directivity index, and oriented to provide an acoustic sound signal from the integral housing that will be transmitted, directly or after reflection from one or more surfaces, through the ceiling to reach a listener in an area of the building comprising the ceiling.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

Figure 1:
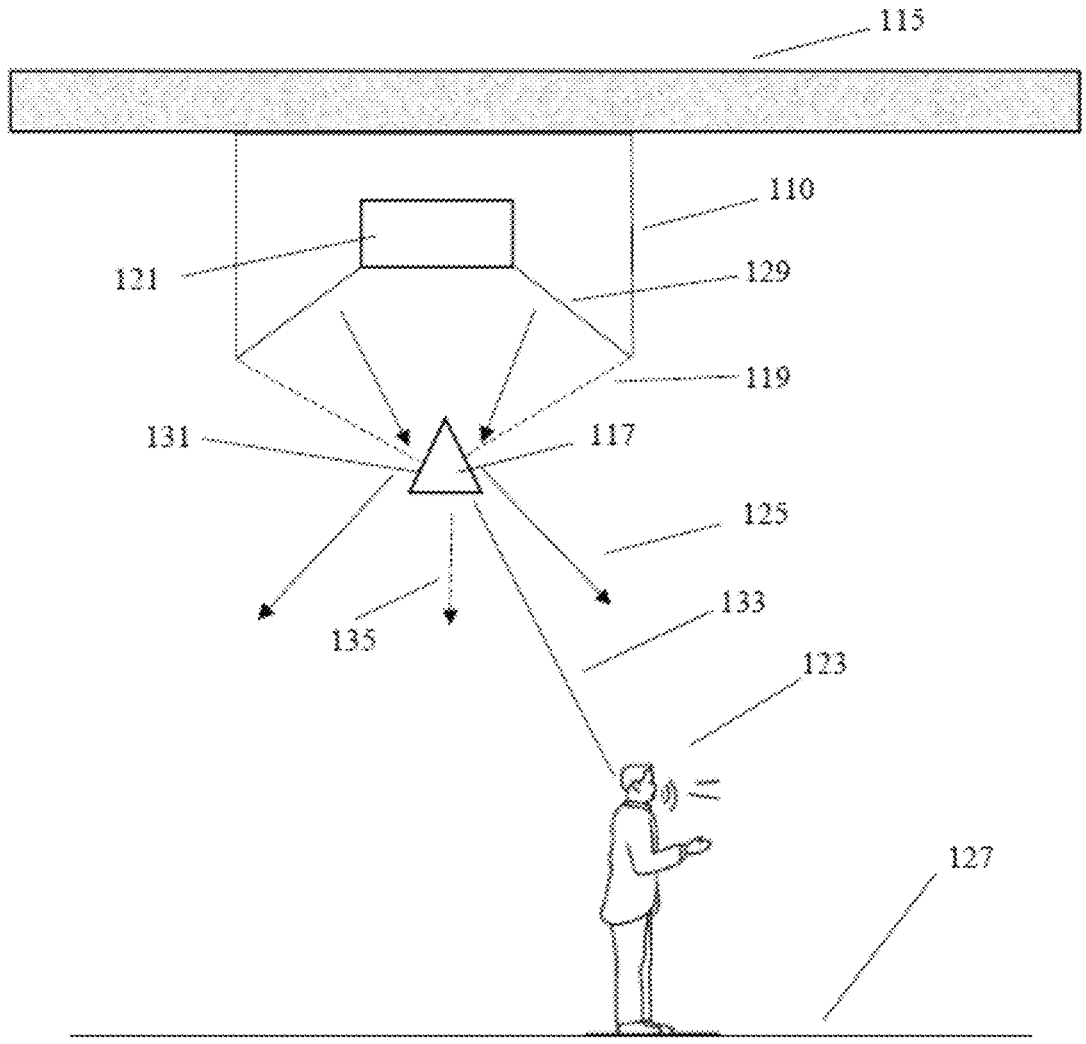
FIG. 1 is a schematic diagram of a commercial lighting system in accordance with example embodiments.

A description of example embodiments follows.

An example embodiment is a system that integrates commercial lighting with loudspeakers for sound masking, paging or music. The system is useful for commercial spaces, such as offices and particularly open plan offices. A low directivity index, direct field type of sound masking system can be used, such as the system taught in U.S. Pat. No. 9,076,430 B2, the entire teachings of which are hereby incorporated herein by reference. A light fixture is, for example, mounted with a loudspeaker assembly in a single integral housing that includes the ability to emit light, and sounds such as sound masking sounds, downwards into an office space.

In one example embodiment, there is provided a commercial lighting system. The system comprises an integral housing adapted to be coupled to a ceiling of a building; a lighting unit mounted to the integral housing; and a loudspeaker assembly mounted to the integral housing, the loudspeaker assembly comprising a low directivity index, and oriented to provide an acoustic sound signal from the integral housing to the ears of a listener in an area of the building comprising the ceiling.

In further, related embodiments, the loudspeaker assembly may be operative to emit the acoustic sound signal corresponding to an electrical sound signal, the electrical sound signal comprising at least one of a sound masking signal, a music signal and a paging signal. The loudspeaker assembly may comprise a voice coil coupled to an audio emitter operative to emit the acoustic sound signal corresponding to the electrical sound signal, the audio emitter comprising a cone emitter.

In another related embodiment, at least part of the lighting unit may be positioned to deflect the acoustic sound signal, emitted from the loudspeaker assembly, prior to reaching the ears of the listener in the area of the building.

In other related embodiments, the loudspeaker assembly may be oriented to provide the acoustic sound signal in a direct path to the ears of the listener. The loudspeaker assembly may comprise a direct field sound masking loudspeaker assembly. The lighting unit may be one of a plurality of lighting units positioned surrounding the loudspeaker assembly. The integral housing may comprise a reflective surface, such as a parabolic mirror, the lighting unit and the loudspeaker assembly being positioned inside the reflective surface. The loudspeaker assembly may comprise a transparent surface, the lighting unit positioned to transmit light through the transparent surface of the loudspeaker assembly.

In further related embodiments, the integral housing may comprise dimensions of a standard ceiling tile unit. The loudspeaker assembly may be surrounded by a light diffuser of the lighting unit; or the loudspeaker assembly may be positioned peripherally to a light diffuser of the lighting unit in the integral housing. The integral housing may comprise a task light housing.

In other related embodiments, the loudspeaker assembly may comprise an audio emitter having an effective aperture area that is less than or equal to the area of a circle having a diameter of 3.0 inches. The acoustic sound signal may comprise an acoustic sound masking signal comprising a corresponding sound masking spectrum, said sound masking spectrum having a low end frequency of at least about 80 Hz and a high end frequency of less than about 5300 Hz. The lighting unit may comprise a light emitting diode lighting unit.

In accordance with another example embodiment, a commercial lighting system comprises an integral housing adapted to be coupled to a ceiling of a building; and a lighting unit mounted to the integral housing. A loudspeaker assembly is mounted to the integral housing, the loudspeaker assembly comprising a low directivity index, and oriented to provide an acoustic sound signal from the integral housing that will be transmitted, directly or after reflection from one or more surfaces, through the ceiling to reach the ears of a listener in an area of the building comprising the ceiling. For example, the loudspeaker assembly is, in one embodiment, oriented upward into a plenum space above a suspended ceiling, so that sound is reflected within the plenum space and ultimately transmitted through the ceiling to the ears of the listener.

FIG. 1 is a schematic diagram of a commercial lighting system in accordance with an example embodiment. The system comprises an integral housing 110 adapted to be coupled to a ceiling 115 of a building, for example using standard ceiling mounting techniques for commercial lighting and sound masking systems. A lighting unit 117 is mounted to the integral housing 110; and a loudspeaker assembly 121 is also mounted to the integral housing 110. The lighting unit 117 is, for example, one or more light emitting diode lighting units. The loudspeaker assembly 121 has a low directivity index, and is oriented to provide an acoustic sound signal 125 from the integral housing 110 to the ears of a listener 123 in an area 127 of the building that includes the ceiling 115. The loudspeaker assembly 121 is operative to emit the acoustic sound signal 125 corresponding to an electrical sound signal, which includes one or more of a sound masking signal, a music signal and a paging signal. The loudspeaker assembly 121 may include a voice coil coupled to an audio emitter operative to emit the acoustic sound signal 125 corresponding to the electrical sound signal, where the audio emitter 129 may be a cone emitter or the like. In another embodiment, a flat panel speaker or other type of loudspeaker emitter may be used.

In the embodiment of FIG. 1, at least part such at the upward surfaces 131 of the lighting unit 117 is positioned to deflect the acoustic sound signal 125, emitted from the loudspeaker assembly 121, prior to reaching the ears of the listener 123 in the area 127 of the building. For example, in FIG. 1, the upward surfaces 131 of the lighting unit 117 function as a small reflector to disperse the acoustic sound signal 125, thereby helping to produce a more diffuse, low directivity sound, while the downward surface emits light 135. The lighting unit 117 is indicated schematically as mounted 119 to the loudspeaker assembly 121, although it will be appreciated that a variety of mounting techniques may be used. The loudspeaker assembly may be oriented to provide the acoustic sound signal in a direct path 133 to the ears of the listener 123, without having been deflected prior to reaching the ears of the listener 123. The loudspeaker assembly 121 may comprise a direct field sound masking loudspeaker assembly, as defined further, below.

Figure 2:
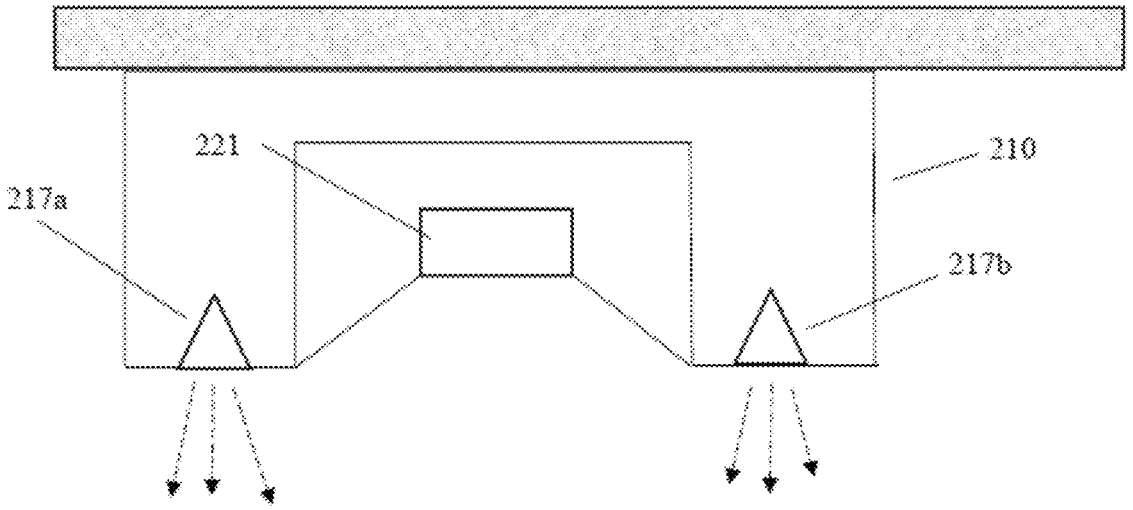
FIG. 2 is a schematic diagram of a commercial lighting system with direct path sound emission, in accordance with example embodiments.

FIG. 2 is a schematic diagram of a commercial lighting system with direct path sound emission, in accordance with an example embodiment. Here, more than one lighting units 217*a* and 217*b* are positioned surrounding the loudspeaker assembly 221, such as by being integrated into housing 210 in a circle pattern (or another pattern) surrounding the loudspeaker assembly 221.

Figure 3:
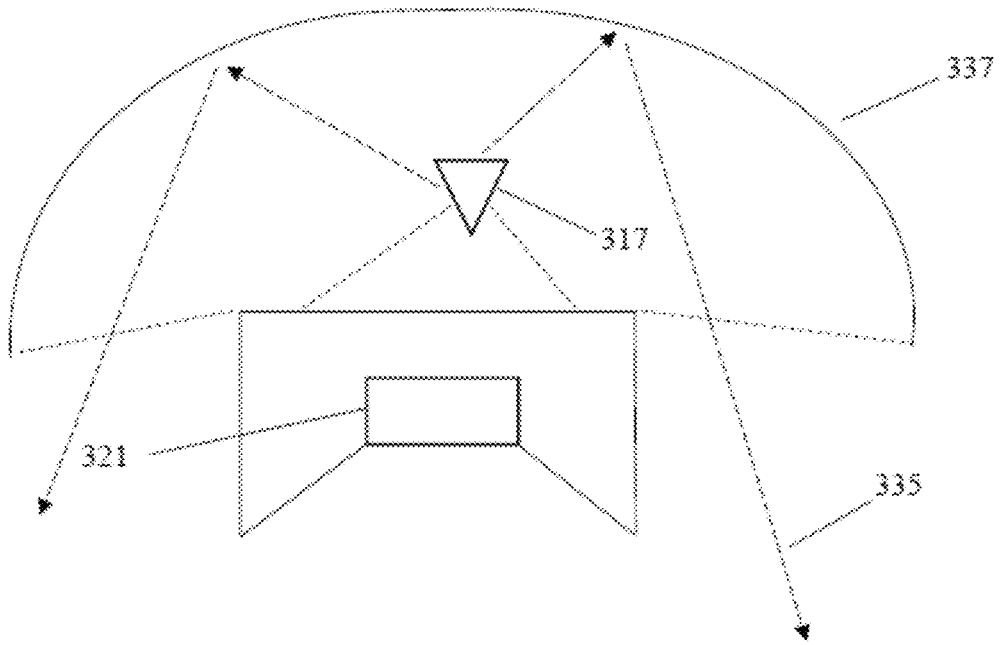
FIG. 3 is a schematic diagram of a commercial lighting system including a reflective surface, in accordance with example embodiments.

FIG. 3 is a schematic diagram of a commercial lighting system including a reflective surface 337, in accordance with an example embodiment. Here, the integral housing includes a reflective surface 337, such as a parabolic mirror, with the lighting unit 317 and the loudspeaker assembly 321 being positioned inside the reflective surface 337, so that light 335 is reflected around the loudspeaker assembly 321 to be emitted out of the lighting system.

Figure 4:
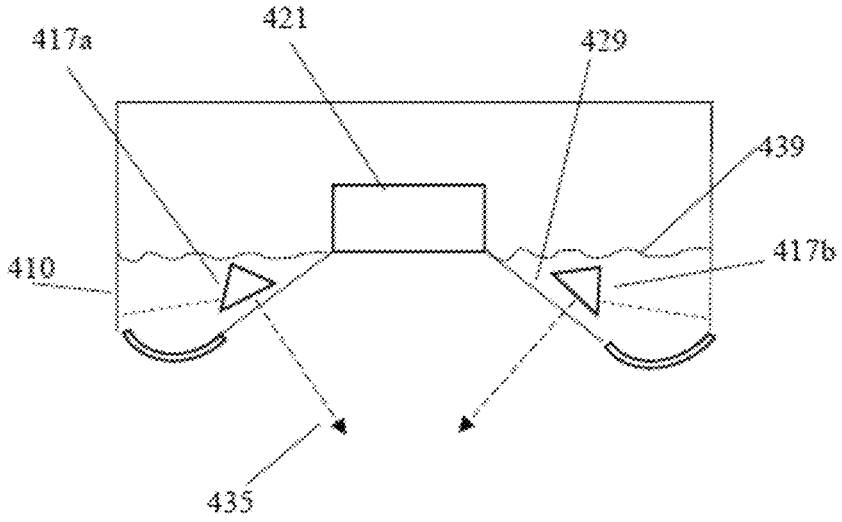
FIG. 4 is a schematic diagram of a commercial lighting system including a transparent surface in accordance with example embodiments.

FIG. 4 is a schematic diagram of a commercial lighting system including a transparent surface 429 in accordance with an example embodiment. Here, the loudspeaker assembly 421 includes a transparent surface 429, and one or more lighting units 417*a*, 417*b* are positioned to transmit light 435 through the transparent surface 429 of the loudspeaker assembly 421. For example, the lighting units 417*a*, 417*b* in FIG. 4 are shown positioned between the "spider" portion 439 of the loudspeaker assembly 421 and the transparent surface 429. The lighting units 417*a*, 417*b* are, for example, mounted to the integral housing 410, and above the transparent surface 429, which also functions as the cone emitter of the loudspeaker assembly 421. The transparent surface 429 is, for example, made of a polymer plastic that vibrates to function as the cone emitter, while also being transparent to light 435.

Figure 5A:
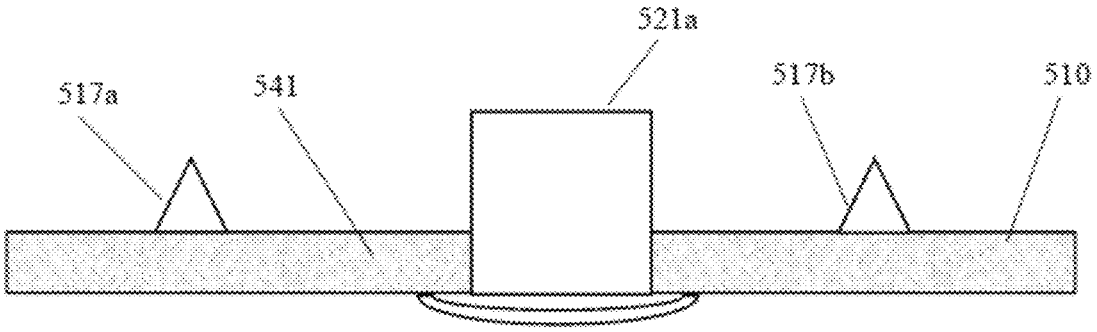
FIGS. 5A and 5B are schematic diagrams of a commercial lighting system in which the integral housing fits the dimensions of a standard ceiling tile unit, in accordance with example embodiments.
Figure 5B:
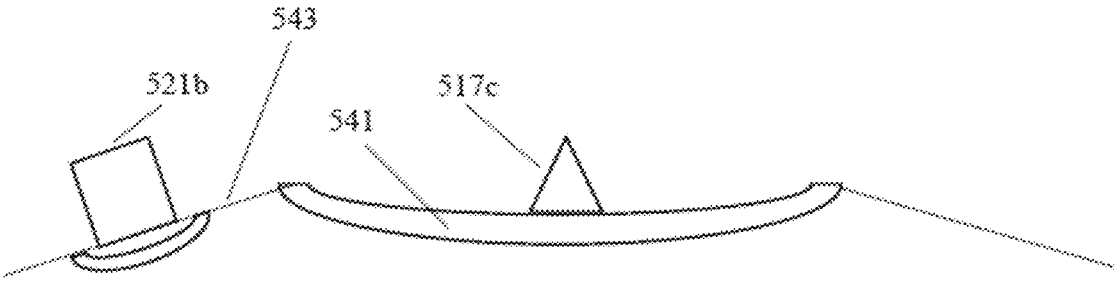

FIGS. 5A and 5B are schematic diagrams of a commercial lighting system in which the integral housing fits the dimensions of a standard ceiling tile unit 510, in accordance with an example embodiment. For example, the ceiling tile unit 510 dimension may be 2 feet by 2 feet, or 2 feet by 4 feet, or another standard ceiling tile dimension. In FIG. 5A, the loudspeaker assembly 521*a* is surrounded by a light diffuser 541 of one or more lighting units 517*a*, 517*b*. In FIG. 5B, the loudspeaker assembly 521*b* is positioned peripherally to the light diffuser 541 of the lighting unit 517*c* in the integral housing, for example in a side plate 543.

In another embodiment, the integral housing 110 (see FIG. 1) is a task light housing, for example for use in an individual workspace.

In other embodiments, the loudspeaker assembly comprises an audio emitter 129 (see FIG. 1) having an effective aperture area that is less than or equal to the area of a circle having a diameter of 3.0 inches. The acoustic sound signal is, for example, an acoustic sound masking signal that has a corresponding sound masking spectrum, and which has a low end frequency of at least about 80 Hz and a high end frequency of less than about 5300 Hz. For example, the cone audio emitter 129 can have an effective aperture area that is less than or equal to the area of a circle having a diameter of between 1.25 inches and 3 inches; and can be of a type that is suitable to function as a direct field, low directivity index cone loudspeaker, such as the type taught in U.S. Pat.

No. 7,194,094 B2 of Horrall et al., the teachings of which patent are incorporated by reference in their entirety.

Figure 6:
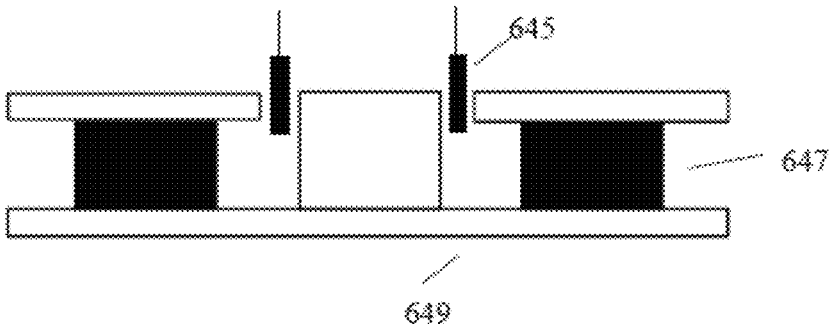
FIG. 6 is a schematic diagram of a voice coil that can be used in a loudspeaker assembly in accordance with example embodiments.

FIG. 6 is a schematic diagram of a voice coil 645 that can be used in a loudspeaker assembly in accordance with an example embodiment. The voice coil includes permanent magnets 647, soft iron 649 and the voice coil 645. Those of skill in the art will appreciate that various types of voice coils can be used in accordance with an example embodiment. For example, the loudspeaker assembly can have a voice coil of a rating of less than or equal to a 5 pound force.

Figure 7:
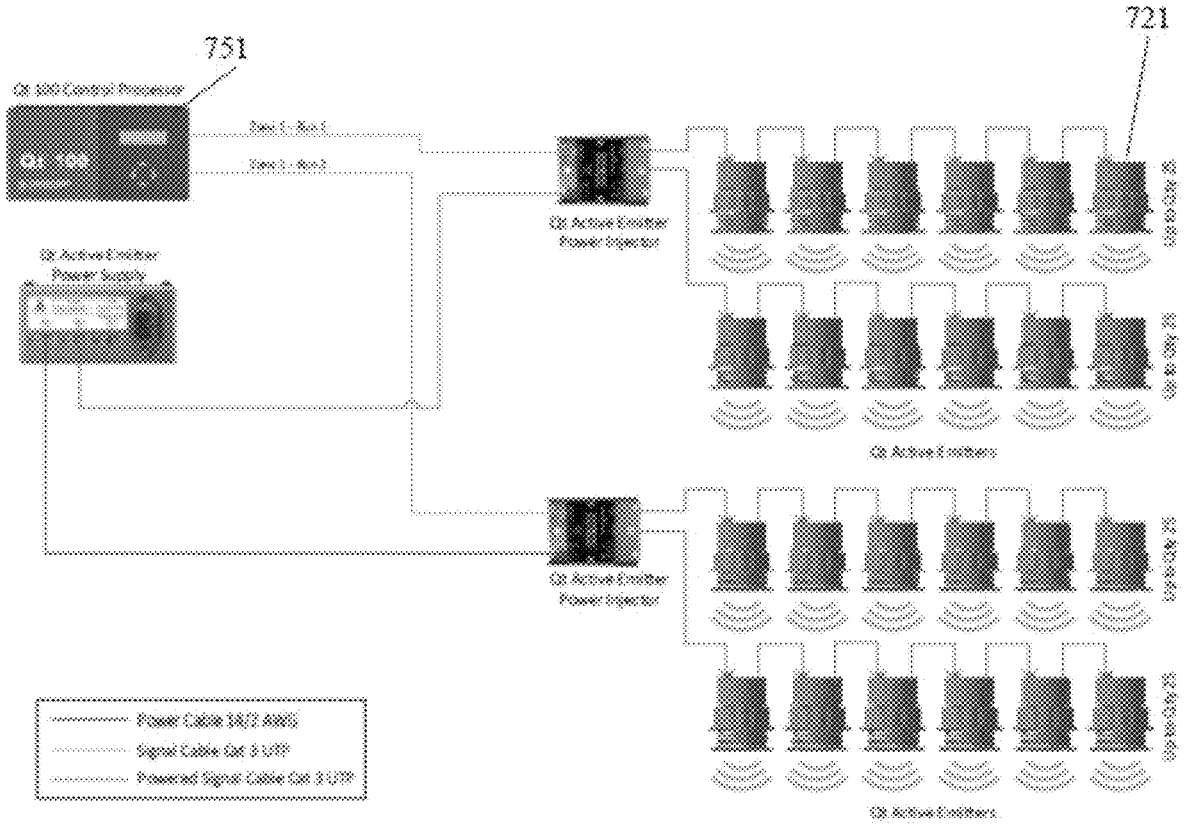
FIG. 7 is a schematic diagram of a sound masking system that includes loudspeakers, in accordance with an example embodiment, which are integrated with a commercial lighting system.

FIG. 7 is a schematic diagram of a sound masking system that includes loudspeakers 721, in accordance with an example embodiment, which are integrated with a commercial lighting system (not shown for the sake of clarity). The sound masking system is used to produce a sound masking zone in a predetermined area of a building, below the loudspeakers. The loudspeakers are coupled via electrical connections to one or more sources such as a controller 751 of an electrical sound signal, which includes a sound masking signal, and which may also include a music signal and/or a paging signal. The loudspeakers 721 emit an acoustic sound signal in response to the electrical sound signal, and, when the sound masking function of the sound masking system is activated, emit an acoustic sound masking signal. The loudspeakers 721 are constructed and oriented to provide the acoustic sound signal to the sound masking zone. For example, the loudspeakers 721 can be positioned facing downwards from a suspended ceiling, so as to transmit the sound masking signal directly to the ears of a listener in the sound masking zone, as shown in FIG. 1.

The sounds played by the loudspeakers 721 can, for example, include dedicated sound masking signals (which use a sound masking spectrum), in order to mask outside, human speech in a context such as an open plan office, or any of a variety of other contexts in which sound masking can be used. The system can also emit a paging address including live or recorded human speech, and can emit music.

Figure 8A:
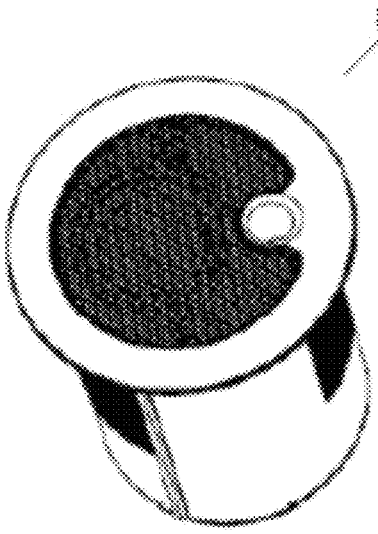
FIG. 8A is a front perspective view.
Figure 8B:
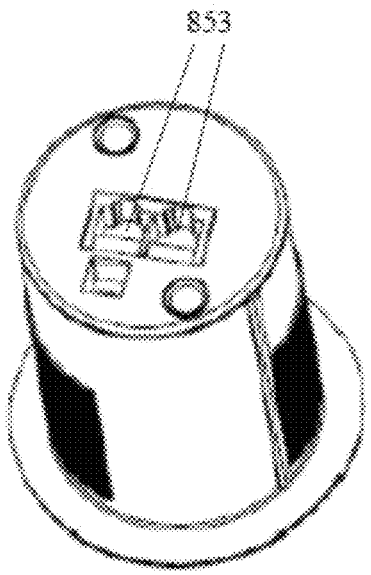
FIG. 8B is a rear perspective view.
Figure 8C:
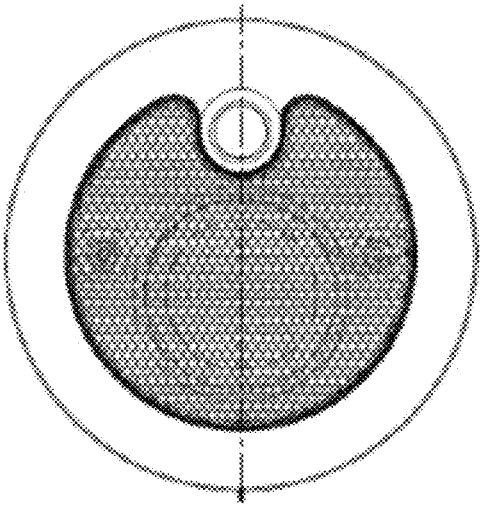
FIG. 8C is a front view, of enclosure of one loudspeaker assembly, in accordance with an example embodiment.

FIG. 8A is a front perspective view, FIG. 8B is a rear perspective view, and FIG. 8C is a front view, of enclosure of one loudspeaker assembly 821, in accordance with an example embodiment. Connections to the loudspeaker assembly 821 can be made with quick connect/disconnect connectors, such as an RJ45 connector, and Ethernet cable. The power voltage carried by the Ethernet cable into the enclosure can, for example, be 36V DC, and the audio signal can come from a controller 751 (see FIG. 7). The power voltage can, for example, be 36 V DC, but can also be higher or another value, such as 48 V DC.

In accordance with an example embodiment, the loudspeaker assembly 821 is designed to minimize the work and effort required to provide a correct installation of the sound masking speakers and associated wiring. The loudspeaker assembly 821 can be connected using readily available and inexpensive wiring, such as CAT-3, 5, 5A or 6 wire. In one embodiment, the plurality of loudspeaker assemblies 821 are interconnected via multi-conductor American Wire Gage (AWG) No. 24 size wiring pieces. To simplify assembly, the wiring pieces are terminated at the ends with quick connect/disconnect connectors, such as RJ-45 or RJ-11 connectors, corresponding to integral input and output jacks 853 on the loudspeakers. This eliminates any need for on-the-job cable stripping. In particular, the quick connect/disconnect connectors can be TIA/EIA-IS-968-A Registered Jack 45 (RJ-45) connectors.

In accordance with an example embodiment, one or more sources of the electrical sound signal can be characterized as a portion of a controller 751 (see FIG. 7). It will be appreciated that the controller 751 can include a microprocessor or other suitable circuitry to implement the control, automation, communication and other computing functions necessary to configure embodiments taught herein.

For an acoustic sound masking signal, a sound masking system in accordance with an example embodiment may use a sound masking spectrum based on the principles of the spectrum described in L. L. Beranek, "Sound and Vibration Control," McGraw-Hill, 1971, Page 593, the teachings of which reference are incorporated by reference in their entirety. The low end frequencies of the selected spectrum can comprise at least one of 50 Hz, 80 Hz, 100 Hz and 125 Hz. The high end frequencies can be less than 8 kHz, 7 kHz, 6 kHz, or about 5300 Hz or less. It will be appreciated that other sound masking spectra may be used. In particular, using a loudspeaker in accordance with an example embodiment, the sound masking spectrum can comprise a frequency response of at least about 40 dB in the 125 Hz one-third octave band of the sound masking spectrum, such as at least about 45 dB in the 125 Hz one-third octave band of the sound masking spectrum. In addition, the sound masking spectrum can comprise a frequency response that falls below about 20 dB in the range of between about 4000 Hz and about 5000 Hz of the sound masking spectrum.

Figure 9:
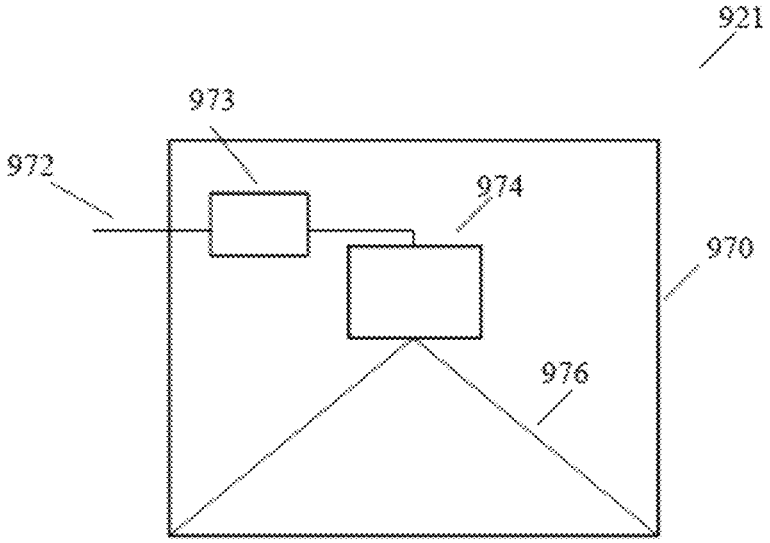
FIG. 9 is a schematic diagram of a loudspeaker assembly in a sound masking system in accordance with an example embodiment.

FIG. 9 is a schematic diagram of a loudspeaker assembly 921 in a sound masking system in accordance with an example embodiment. The loudspeaker assembly 921 includes a substantially airtight case 970, an input connection 972, an input network 973 and a voice coil 974 that is coupled to audio emitter 976, which can be a cone emitter. The audio emitter 976 is operative to emit the acoustic sound masking signal. The cone loudspeaker assembly 921 comprises a low directivity index loudspeaker. In one embodiment, the loudspeaker assemblies in the sound masking system may be low directivity index loudspeakers. Returning to FIG. 9, a loudspeaker assembly 921 can have an audio emitter 976, such as a cone emitter, having an effective aperture area that is less than or equal to the area of a circle having a diameter of 3.0 inches; or that is less than or equal to the area of a circle having a diameter of 1.5 inches; or that is equal to the area of a circle having a diameter of between 1.25 inches and 3 inches; and may be of a type that is suitable to function as a direct field, low directivity index cone loudspeaker, such as the type taught in U.S. Pat. No. 7,194,094 B2 of Horrall et al., the teachings of which patent are incorporated by reference in their entirety. As used herein, a "direct field sound masking system" is one in which the acoustic sound masking signal or signals, propagating in a direct audio path from one or more emitters, dominate over reflected and/or diffracted acoustic sound masking signals in the sound masking zone. A "direct audio path" is a path in which the acoustic masking signals are not reflected or diffracted by objects or surfaces and are not transmitted through acoustically absorbent surfaces within a masking area or zone.

Figure 10:
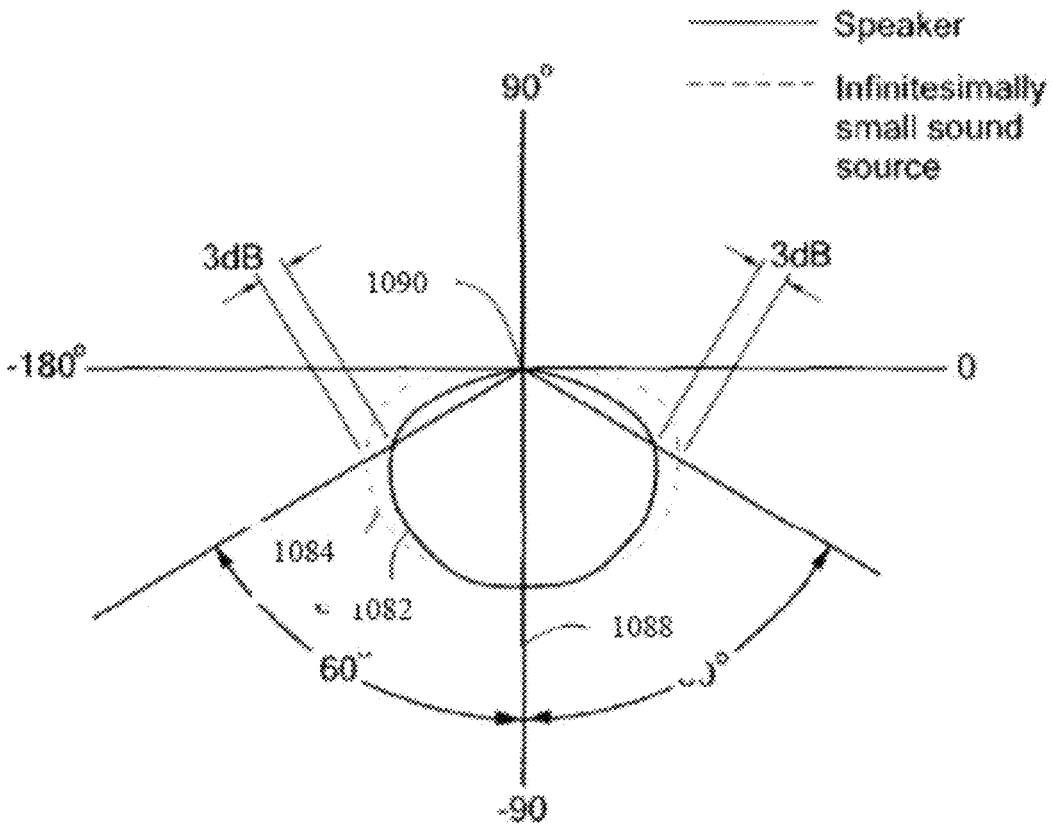
FIG. 10 is a schematic diagram illustrating a low directivity index loudspeaker that can be used in accordance with an example embodiment.

FIG. 10 is a schematic diagram illustrating a low directivity index loudspeaker that can be used in accordance with an embodiment. A loudspeaker with a "low directivity index" is one that, with reference to the axial direction 1088 of the speaker, at location 1090 provides an output sound intensity 1082 at an angle of 20 degrees, preferably 45 degrees, and most preferably 60 degrees from the axial direction, that is not more than 3 dB, and not less than 1 dB, lower than the output sound intensity 1084 at the same angle from an infinitesimally small sound source at the same location in an infinite baffle at frequencies less than 6000 Hz, as measured in any one-third octave band. Accordingly, the low directivity index loudspeakers provide a substantially uniform acoustic output that extends nearly 180 degrees, i.e., plus or minus 90 degrees from the axial direction of the loudspeaker assembly.

In accordance with another embodiment, a commercial lighting system comprises an integral housing adapted to be coupled to a ceiling of a building; and a lighting unit mounted to the integral housing. A loudspeaker assembly is mounted to the integral housing, the loudspeaker assembly comprising a low directivity index, and oriented to provide an acoustic sound signal from the integral housing that will be transmitted, directly or after reflection from one or more surfaces, through the ceiling to reach the ears of a listener in an area of the building comprising the ceiling. For example, the loudspeaker assembly is, in one embodiment, oriented upward into a plenum space above a suspended ceiling, so that sound is reflected within the plenum space and ultimately transmitted through the ceiling to the ears of the listener.

FIGS. 11A-11E are schematic diagrams of further commercial lighting systems in accordance with various embodiments.

Figure 11A:
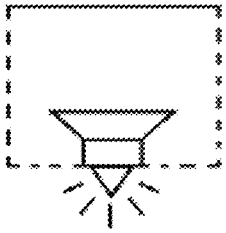
FIGS. 11A-11E are schematic diagrams of further commercial lighting systems in accordance with an example embodiment.

In the embodiment of FIG. 11A, an integral housing enclosure is acoustically transparent on the bottom and sides, and reflective on top. The loudspeaker assembly is aimed upward to reflect the sound off the roof of the enclosure. The lighting unit hangs below.

Figure 11B:
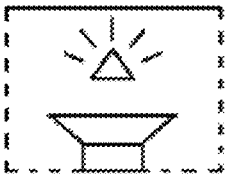

In the embodiment of FIG. 11B, the lighting unit is also reflecting off the roof of the integral housing enclosure.

Figure 11C:
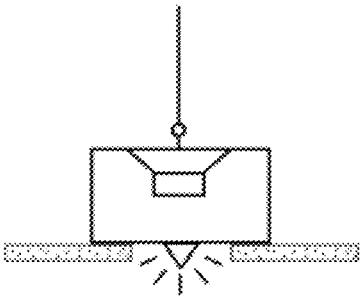

In the embodiment of FIG. 11C, there is an upward-firing in-plenum type loudspeaker assembly, with the lighting unit incorporated underneath. The acoustic ceiling tile underneath has a cutout for the lighting unit.

Figure 11D:
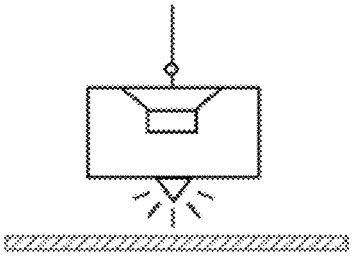

In the embodiment of FIG. 11D, the ceiling tile under the in-plenum loudspeaker assembly is transparent to allow for the light from the lighting unit to pass through.

Figure 11E:
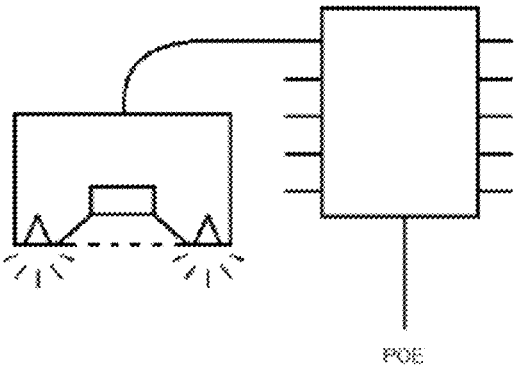

In the embodiment of FIG. 11E, the system uses Power over Ethernet (POE) based controllers to simultaneously control the sound and the light for combined sound/light fixtures according to example embodiments.

In accordance with an example embodiment, a single cable or a single shared power source, or both, can be used for the loudspeaker assembly and the lighting unit that are integrated in the commercial lighting system.

In accordance with another example embodiment, the system additionally includes an array of microphones to perform far field sound analysis. A far field sound analysis is the mapping of sound sources. An array of loud speakers take the far field sound mapping and perform acoustic beam forming for noise and echo cancellation. In one example, the microphone array listens for noises in a corridor and cancels the noises in cubicles. In this way those having a conversation are unimpeded and those in the cubicles are undisturbed.

The teachings of all patents, published applications and references cited herein are incorporated by reference in their entirety.

While example embodiments have been particularly shown and described, it will be understood by those skilled in the art that various changes in form and details may be made therein without departing from the scope of the embodiments encompassed by the appended claims.

What is claimed is:

1. A commercial lighting system, the system comprising:

an integral housing adapted to be coupled to a ceiling of a building;

a plurality of lighting units mounted to the integral housing; and a loudspeaker assembly mounted to the integral housing, the loudspeaker assembly comprising a low directivity index, and oriented to provide an acoustic sound signal from the integral housing to a listener in an area of the building comprising the ceiling, and wherein the plurality of lighting units are positioned at same corresponding angles each angled towards one another on opposing sides of the loudspeaker assembly and outside an area of a downward facing portion of the loudspeaker assembly, and above a transparent surface of the integral housing, and wherein each of the plurality of lighting units are positioned below a bottom surface portion of the loudspeaker assembly.

2. The commercial lighting system of claim 1 wherein the loudspeaker assembly is operative to emit the acoustic sound signal corresponding to an electrical sound signal, the electrical sound signal comprising at least one of a sound masking signal, a music signal and a paging signal.

3. The commercial lighting system of claim 2 wherein the loudspeaker assembly comprises a voice coil coupled to an audio emitter operative to emit the acoustic sound signal corresponding to the electrical sound signal, the audio emitter comprising a cone emitter.

4. The commercial lighting system of claim 1 wherein the loudspeaker assembly is oriented to provide the acoustic sound signal in a direct path to the listener.

5. The commercial lighting system of claim 1 wherein the loudspeaker assembly comprises a direct field sound masking loudspeaker assembly.

6. The commercial lighting system of claim 1 wherein the integral housing comprises dimensions of a standard ceiling tile unit.

7. The commercial lighting system of claim 1 wherein the integral housing comprises a task light housing.

8. The commercial lighting system of claim 1 wherein the loudspeaker comprises an audio emitter having an effective aperture area that is approximately less than the area of a circle having a diameter of 3.0 inches.

9. The commercial lighting system of claim 1 wherein the acoustic sound signal comprises an acoustic sound masking signal comprising a corresponding sound masking spectrum, said sound masking spectrum having a low end frequency of at least approximately 80 Hz and a high end frequency of less than approximately 5300 Hz.

10. The commercial lighting system of claim 1 wherein the plurality of lighting units comprises a light emitting diode lighting unit.

* * * * *